US005174560A

United States Patent [19]

Fujii

[11] Patent Number: 5,174,560

[45] Date of Patent: Dec. 29, 1992

[54] SHEET SUPPLY APPARATUS

[75] Inventor: Tadashi Fujii, Minamiashigara, Japan

[73] Assignee: Fuji Photo Film Co., Ltd., Kanagawa, Japan

[21] Appl. No.: 886,193

[22] Filed: May 21, 1992

[30] Foreign Application Priority Data

May 24, 1991 [JP] Japan ..... 3-120410

[51] Int. Cl.[5] ..... B65H 5/08

[52] U.S. Cl. ..... 271/15; 271/107; 271/227; 271/234; 271/246; 271/253

[58] Field of Search ..... 271/11, 5, 12, 13, 15, 271/225, 227, 235, 234, 242, 245, 246, 253, 275, 107, 228, 234

[56] References Cited

U.S. PATENT DOCUMENTS

| | | | |
|---|---|---|---|
| 3,637,203 | 1/1972 | French | 271/246 |
| 4,492,455 | 1/1985 | Kawai | 271/246 |
| 4,564,187 | 1/1986 | Costa et al. | 271/246 |
| 4,805,892 | 2/1989 | Calhoun | 271/242 |
| 5,080,343 | 1/1992 | Kushima et al. | 271/5 |

FOREIGN PATENT DOCUMENTS

| | | | |
|---|---|---|---|
| 0013539 | 1/1990 | Japan | 271/227 |

*Primary Examiner*—H. Grant Skaggs
*Attorney, Agent, or Firm*—Sughrue, Mion, Zinn, Macpeak & Seas

[57] ABSTRACT

A sheet supply apparatus supplies a sheet such as an X-ray sheet film from a cassette to a recording device. The sheet supply apparatus has at least a pair of rollers for gripping and feeding a sheet, a feeding mechanism for feeding a sheet from a storage cassette and supplying the sheet along a feed path to the pair of rollers, a tilt correcting mechanism having for correcting the sheet out of a tilted condition with respect to a direction transverse to the feed path, and a position correcting mechanism for displacing the pair of rollers in the direction while the pair of rollers is gripping the sheet, to correct the sheet positionally with respect to the direction. The feeding mechanism has suction devices movable into the feed path for attracting the sheet under vacuum, and the tilt correcting mechanism has at least a pair of stoppers movable into the feed path for engaging a leading end of the sheet to correct the sheet out of the tilted condition. The sheet supply apparatus also has a drive mechanism for displacing the suction devices and the stoppers between the feed path and respective positions outside of the feed path.

12 Claims, 9 Drawing Sheets

SHEET SUPPLY APPARATUS

BACKGROUND OF THE INVENTION

1. Field of the Invention

The present invention relates to a sheet supply apparatus for taking sheets such as films, one by one, from a storage cassette, correcting the position of the sheet, and supplying the sheet to another mechanism.

2. Description of the Prior Art

Sheet films such as X-ray films for use in medical organizations, e.g., hospitals, are used to take pictures while they are being stored in cassettes. After a desired picture is photographed on a sheet film in a cassette, it is removed from the cassette, ID information such as a date, patient information, etc., is recorded on the sheet film, and then the sheet film is supplied to a developing device.

There is employed a sheet supply apparatus for feeding the sheet film from the cassette, recording the ID information on the removed sheet film, and then supplying the sheet film to the developing device. In the sheet supply apparatus, it is necessary to supply the sheet film accurately to a recording unit in order to record the ID information accurately in a predetermined position on the sheet film. The sheet film in the cassette may not necessarily be held in a constant position, and may be positionally displaced when it is taken out of the cassette.

In a certain sheet supply apparatus, a sheet film taken out of its cassette is positioned as follows: The sheet film taken out of the cassette is first fed upwardly so as to be held in an upright posture, corrected, by gravity, out of any tilted condition with respect to the direction in which it is fed, and then displaced horizontally, so that the position of the sheet film is corrected with a direction perpendicular to the direction in which it is fed.

The sheet supply apparatus of the above mechanism is however relatively large in the vertical direction as the sheet film is held in the upright posture. When the sheet film is corrected from a tilted condition with respect to the direction in which it is fed, the sheet film is required to be released from rollers. However, upon release from the rollers, the sheet film tends to be curved and may not well and smoothly be fed after the positioning of the sheet film is completed. Furthermore, when the sheet film is positionally corrected with respect to the direction perpendicular to the direction in which it is fed, the sheet film is liable to rub its recording surface against a guide plate or the like, resulting in damage of the recording surface.

SUMMARY OF THE INVENTION

It is an object of the present invention to provide a sheet supply apparatus which is relatively small in size and is capable of quickly and accurately positioning a sheet that has been taken out of a storage cassette.

Another object of the present invention is to provide a sheet supply apparatus which requires no special positioning station for positioning a sheet and which is relatively small in size and simple in mechanism.

Still another object of the present invention is to provide a sheet supply apparatus which allows a sheet to be fed well and smoothly and which does not damage the surface of the sheet.

According to the present invention, there is provided a sheet supply apparatus comprising at least a pair of rollers for gripping and feeding a sheet, a feeding mechanism for feeding a sheet from a storage cassette and supplying the sheet along a feed path to the pair of rollers, the feeding mechanism having suction means movable into the feed path for attracting the sheet under vacuum, a skew correcting mechanism having for correcting the sheet from a skewed condition with respect to a direction transverse to the feed path, the skew correcting mechanism having at least a pair of stoppers movable into the feed path for engaging a leading end of the sheet to correct the sheet from the skewed condition, a position correcting mechanism for displacing the pair of rollers in the direction while the pair of rollers is gripping the sheet, to correct the sheet positionally with respect to the direction, and a drive mechanism for displacing the suction means and the stoppers between the feed path and respective positions outside of the feed path.

The suction means comprises at least one suction cup for attracting the sheet under vacuum.

The feeding mechanism comprises a motor, a pulley, a belt operatively interconnecting the motor and the pulley for rotating the pulley in response to energization of the motor, and a link coupled to the pulley for displacing the suction means along the feed path upon rotation of the pulley.

The stoppers are spaced from each other in the above direction.

The sheet supply apparatus further includes first and second shafts on which the pair of rollers is mounted respectively, the skew correcting mechanism comprising a third shaft extending parallel to the first and second shafts, at least a pair of arms mounted on the third shaft and spaced from each other, the stoppers being fixed to the arms, respectively, for abutting engagement with the sheet.

The position correcting mechanism comprises displacing means for displacing the pair of rollers, and detecting means for detecting the sheet gripped by the pair of rollers displaced by the displacing means.

The sheet supply apparatus further includes first and second shafts on which the pair of rollers is mounted respectively, the displacing means comprising, a holder mounted on the second shaft, a link pivotally coupled to the holder, and a motor operatively coupled to the link for angularly moving the link to displace the pair of rollers in the direction.

The detecting means comprises a photoelectric sensor having a light-emitting element and a light-detecting element.

The drive mechanism includes means for moving the rollers toward and away from each other.

The drive mechanism includes means for displacing the suction means away from the feed path.

The drive mechanism includes means for pressing the rollers against each other in a direction transverse to the feed path.

Alternatively, drive mechanism includes first means for displacing the suction means away from the feed path, second means for moving the rollers toward and away from each other, third means for displacing the stoppers between the position outside of the feed path and a position between the rollers, and a single actuator for actuating the first, second, and third means.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
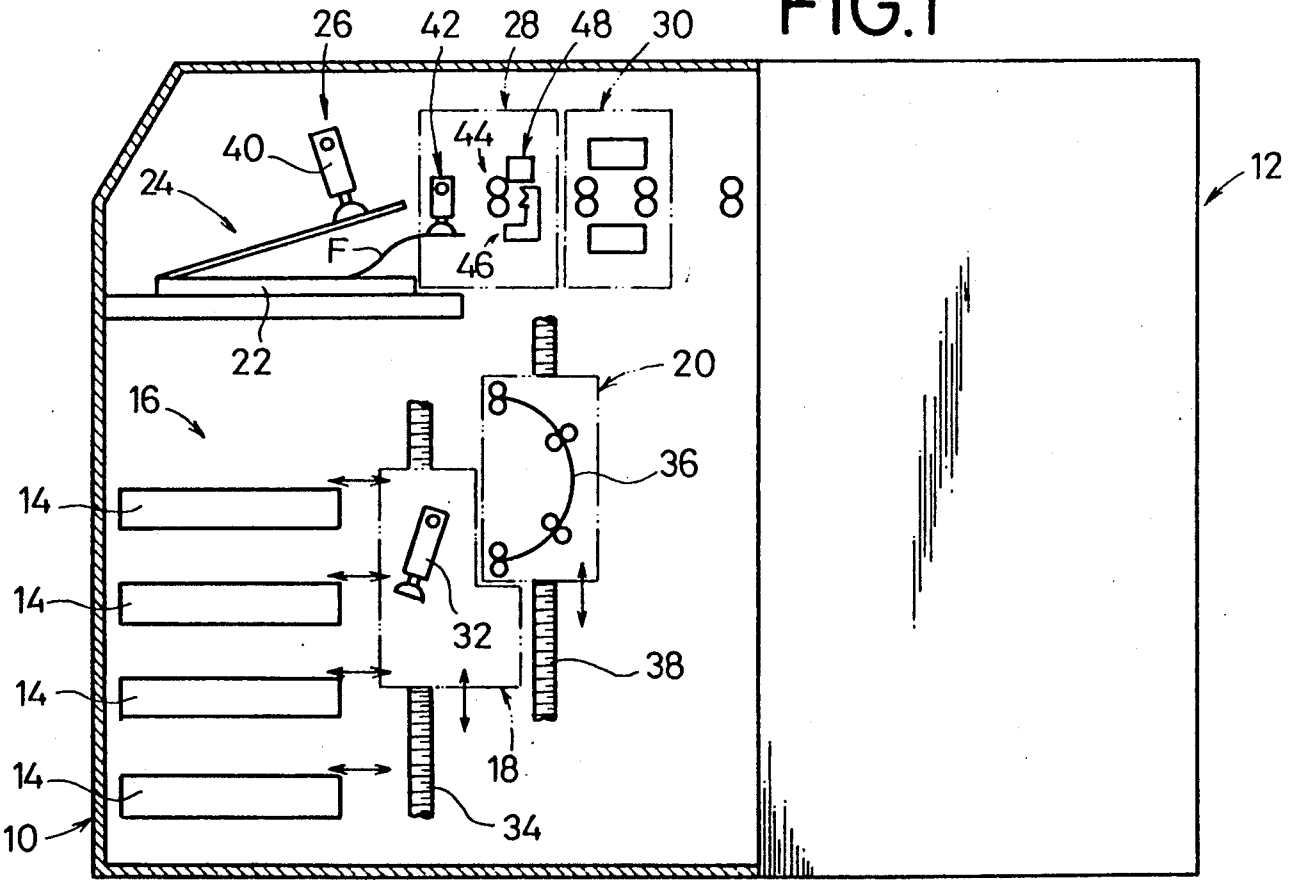
FIG. 1 is a schematic side elevational view, partly cut away, of a sheet supply apparatus according to the present invention.

FIG. 1 schematically shows a sheet supply apparatus, generally designated by the reference numeral 10, according to the present invention. The sheet supply apparatus 10 is combined with a known developing device 12.

The sheet supply apparatus 10 generally comprises a magazine loading region 16 loaded with a plurality of magazines 14 storing unexposed films of different sizes, a first sheet feeding mechanism 18 for feeding an unexposed film from the magazine loading region 16, a feed mechanism 20 for feeding the unexposed film removed by the first sheet feeding mechanism 18, a cassette loading region 24 loaded with a cassette 22 which stores the unexposed film or an exposed film F, a lid opening mechanism 26 for opening a lid of the cassette 22, a feeding and positioning mechanism 28 for feeding the exposed film F from the cassette 22 and positioning the exposed film F thus fed, and an ID information recording device 30 for recording ID information on the exposed film F.

Each of the magazines 14 is movable toward and away from the first sheet feeding mechanism 18 as indicated by the horizontal arrows. The first sheet feeding mechanism 18 has a suction device 32 for attracting and feeding a film from the magazines 14. The first sheet feeding mechanism 18 is vertically movable along a vertical shaft 34 as indicated by the vertical arrows. The feed mechanism 20 has a curved feed path 36, and is vertically movable along a vertical shaft 38 as indicated by the arrows between the magazine loading region 16 and the cassette loading region 24.

The lid opening mechanism 26 has a suction device 40 for attracting and opening the lid of the cassette 2.

The feeding and positioning mechanism 28 comprises a second sheet feeding mechanism 42 for feeding the exposed film F from the cassette 22, a grip feed mechanism 44 for gripping and feeding the exposed film F to the ID information recording device 30, a tilt correcting mechanism 46 for correcting the exposed film F out of a tilted condition with respect to the direction (hereinafter referred to as the "feed direction") in which the exposed film F is fed along a feed path, a position correcting mechanism 48 (see FIG. 2) for displacing the exposed film F in a direction perpendicular to the feed direction to correct the position of the exposed film F, and a drive mechanism 50 (see FIGS. 3 and 4) for driving the second sheet feeding mechanism 42, the grip feed mechanism 44, and the tilt correcting mechanism 46, and the position correcting mechanism 48 with predetermined timing.

Figure 5:
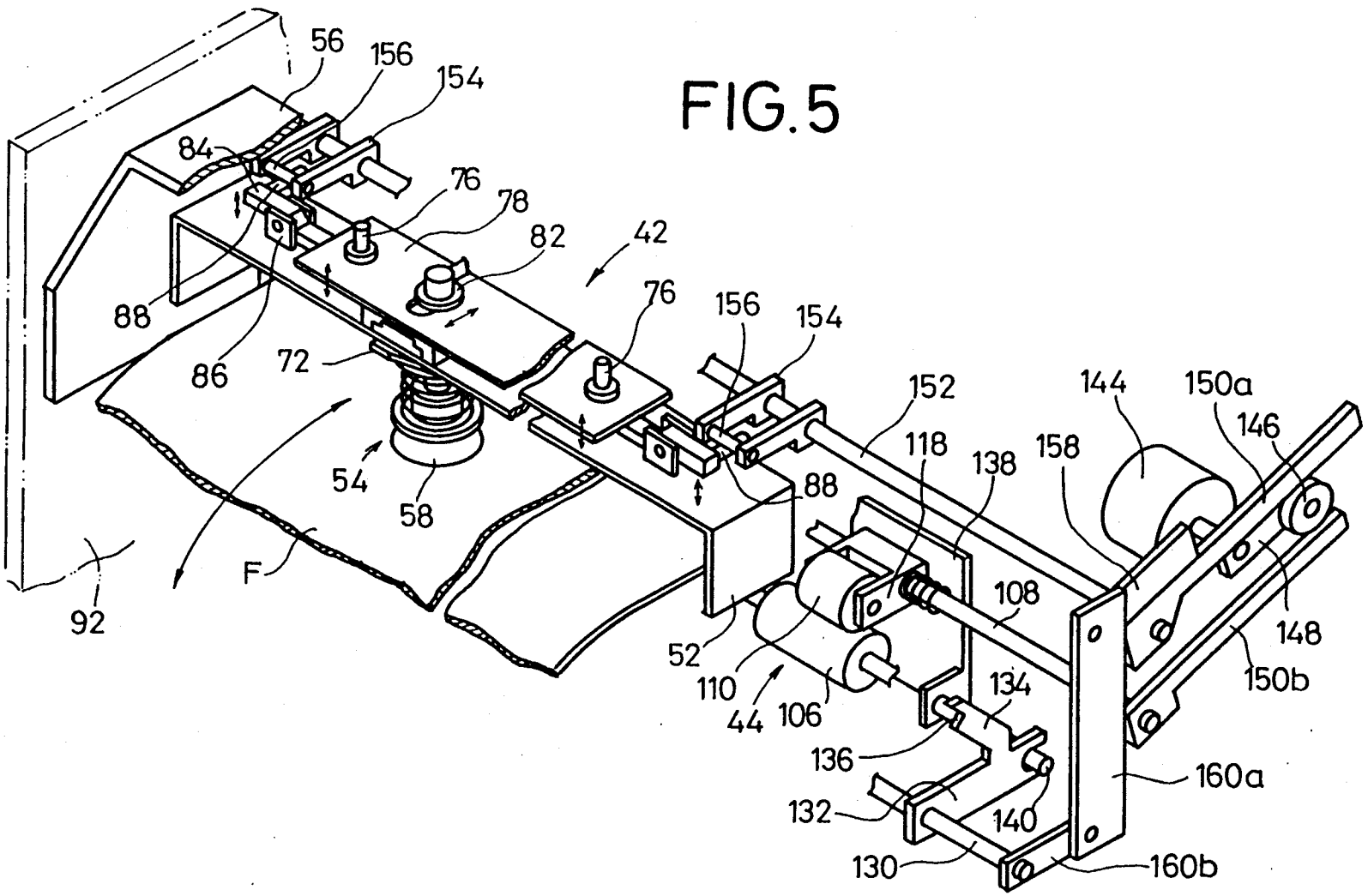
FIG. 5 is a fragmentary perspective view of a second sheet feeding mechanism.

As shown in FIG. 5, the second sheet feeding mechanism 42 has a plurality of suction devices 54 mounted on a bracket 52 and arrayed in a direction perpendicular to the feed direction of the exposed film F. The bracket 52 is pivotally attached to a frame 56 that can be displaced between the cassette 22 and the grip feed mechanism 44 by a mechanism which will be described later on.

Figure 6:
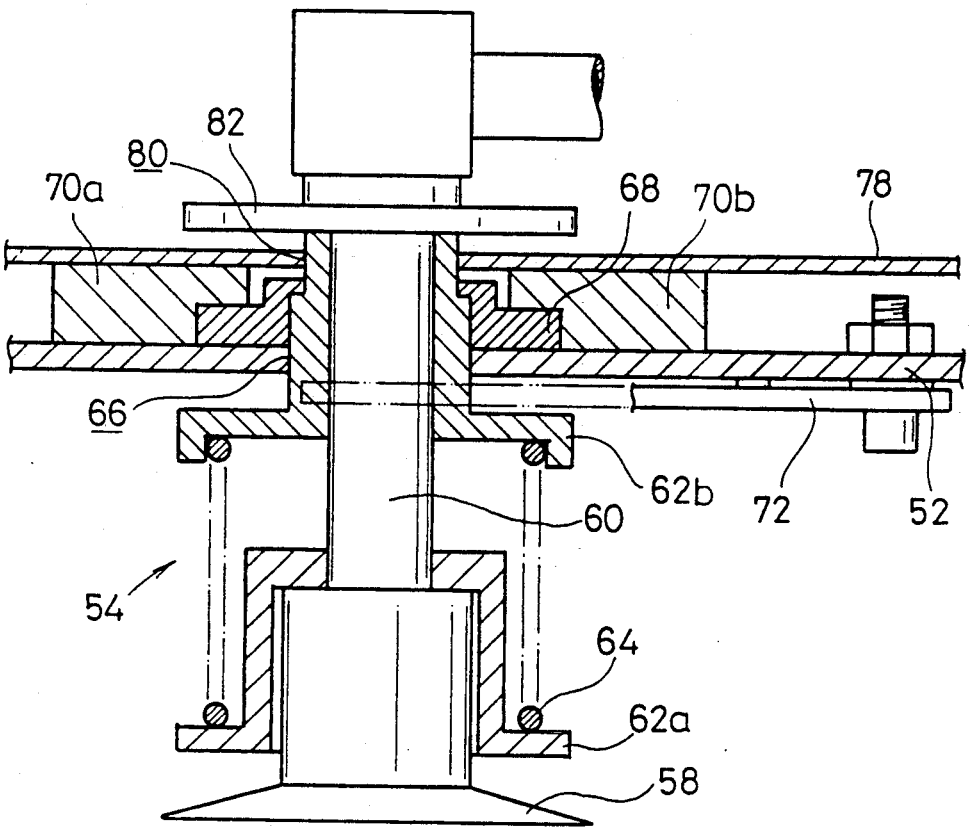
FIG. 6 is an enlarged vertical cross-sectional view of a suction device of the second sheet feeding mechanism shown in FIG. 5.

As shown in FIG. 6, each of the suction devices 54 has a suction cup 58 for attracting the exposed film F under vacuum, and a pipe 60 interconnecting the suction cup 58 and a vacuum source (not shown). Two lower and upper caps 62*a*, 62*b* are mounted on the pipe 60 with a coil spring 64 interposed between the caps 62*a*, 62*b*. The upper cap 62*b* is inserted in an elongate hole 66 defined in the bracket 52, the elongate hole 66 being elongate in the feed direction of the exposed film F. The upper cap 62*b* has an upper end projected upwardly from the bracket 52 and to which a slide member 68 is fixed. The slide member 68 is guided by two guide members 70*a*, 70*b* fixed to the upper surface of the bracket 52. On the lower surface of the bracket 52, there is disposed a engaging lever 72 having one end pivotally coupled to the bracket 52 and the other end engaging an outer circumferential surface of the cap 62*b* (see FIG. 7). The engaging lever 72 is normally urged by a coil spring 74 to displace the suction device 54 in the feed direction, while allowing the suction device 54 to move in a direction opposite to the feed direction against the bias of the coil spring 74. Preferably, the suction device 54 should be angularly movable in a direction to correct the exposed film F out of a tilted condition.

As shown in FIG. 5, an elongate guide plate 78 is placed over the bracket 52 and has opposite ends coupled to the bracket 52 by guide pins 76. The guide plate 78 has an elongate hole 80 defined therein at a position aligned with the suction device 54. The pipe 60 of the suction device 54 extends through the hole 80. A flange 82 is mounted on the upper end of the pipe 60 which projects upwardly from the hole 80. Two levers 84 have ends held against the lower surfaces, respectively, of the opposite ends of the guide plate 78. Each of the levers 84 has a central portion pivotally coupled to a support 86 fixedly mounted on the upper surface of the bracket 52. A pin 88 which extends in the feed direction is secured to the other end of the lever 84 remote from the guide plate 78. When the pins 88 of the levers 84 are depressed by a mechanism described later on, the levers 84 are turned about the supports 86, lifting the guide plate 78 away from the bracket 52.

Figure 8:
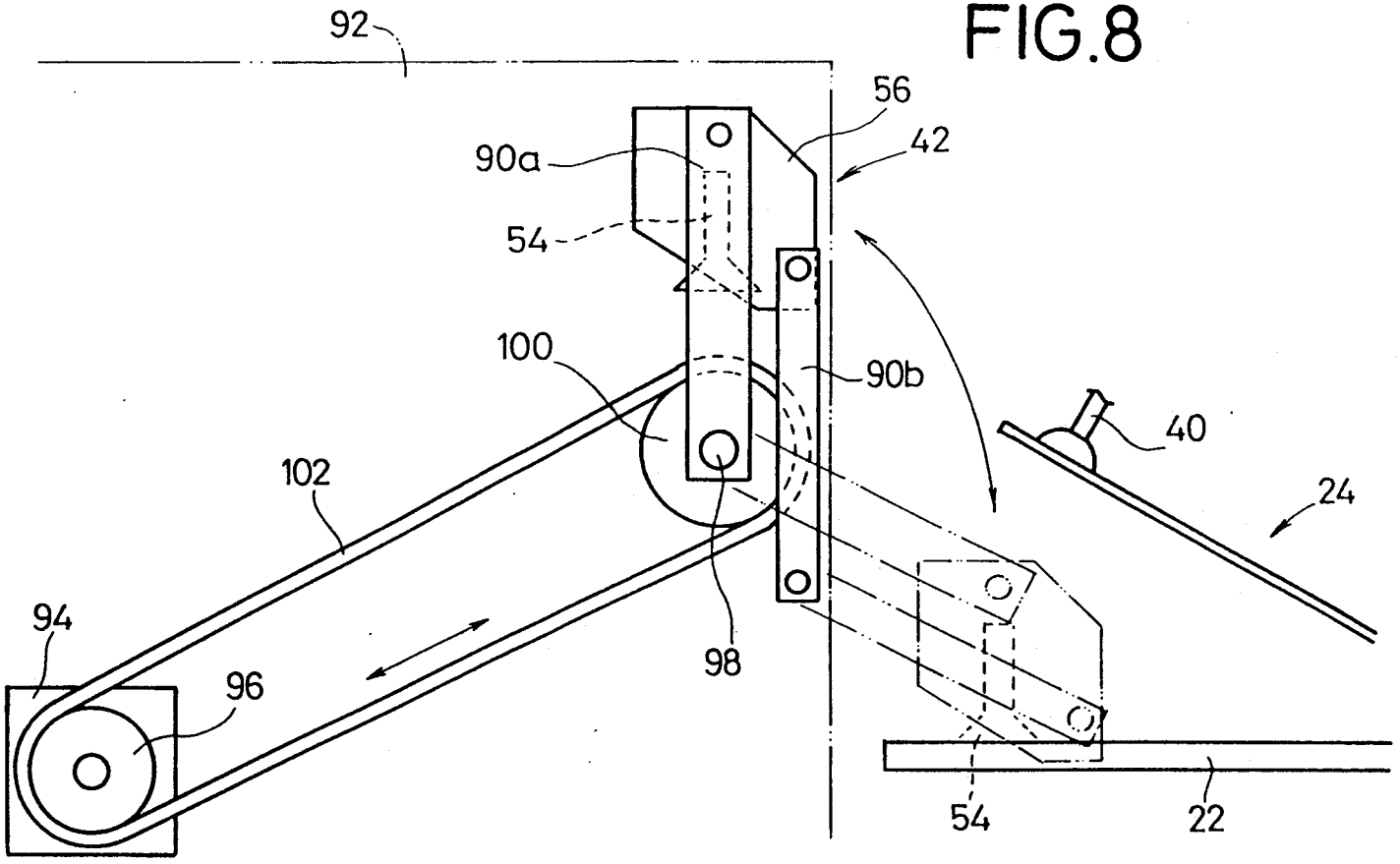
FIG. 8 is a side elevational view of a drive mechanism for the second sheet feeding mechanism.

As illustrated in FIG. 8, the frame 56 has its opposite end portions supported by respective links 90*a*, 90*b* which extend parallel to each other. The links 90*a*, 90*b* have ends pivotally coupled to one of a pair of spaced side plates 92 (only one shown) vertically disposed in the sheet supply apparatus 10 and opposite ends pivotally coupled to the frame 56. The links 90*a*, 90*b*, the frame 56, and the side plate 92 thus jointly constitute a parallel link mechanism. A motor 94 is mounted on the side plate 92 and has a drive shaft on which a pulley 96 is mounted. An endless belt 102 is trained around the pulley 96 and another pulley 100 that is mounted on a shaft 98 by which the link 90*a* is pivotally attached to the side plate 92. When the motor 94 is energized, the second sheet feeding mechanism 42 is thus angularly displaceable between the cassette 22 and the grip feed mechanism 44 through the links 90*a*, 90*b*.

The grip feed mechanism 44 will be described below with reference to FIG. 2. The grip feed mechanism 44 serves to feed the exposed film F into the ID information recording device 30 and also to position the exposed film F in the direction perpendicular to the feed direction of the exposed film F. The grip feed mechanism 44 comprises a plurality of rollers 106 mounted on a shaft 104 whose opposite ends are rotatably supported by the side plates 92, and a plurality of rollers 110 mounted on a shaft 108 whose opposite ends are angularly movably coupled to the shaft 104, the rollers 110 being movable toward and away from the rollers 106, respectively.

One of the ends of the shaft 104 is operatively coupled to a rotary actuator (not shown) of the drive mechanism 50 through a pair of intermeshing gears 105*a*, 105*b*. On the other end of the shaft 104, there is mounted a bracket 114 which is normally urged in the axial direction of the shaft 104 by a coil spring 112. The shafts 104, 108 are coupled to each other by a joint 116. Therefore, the shafts 104, 108 are normally biased toward one of the side plates 92 (shown in FIG. 2) under the resiliency of the coil spring 112.

The rollers 110 are supported on respective brackets 118 which are in turn pivotally mounted on the shaft 108. The brackets 118 are normally urged toward the rollers 106 under the bias of coil springs 120 disposed around the shaft 108. The rollers 110 are angularly movable with respect to the shaft 108 in a limited angular range defined by stoppers (not shown) mounted on the shaft 108. When the shaft 108 is turned about its own axis through a certain angular interval, the rollers 110 are brought into abutment against the respective rollers 106. Upon further turning movement of the shaft 108, the rollers 110 are pressed against the respective rollers 106 under the bias of the coil springs 120.

The position correcting mechanism 48 is operatively coupled to the shaft 108. The position correcting mechanism 48 comprises a holder 120 mounted on the shaft 108, a link 123 coupled to the holder 120, and a motor 125 coupled to the link 123. When the motor 125 is energized, the link 123 is displaced to displace the shaft 108 axially in a direction perpendicular to the feed direction of the exposed film F.

Figure 2:
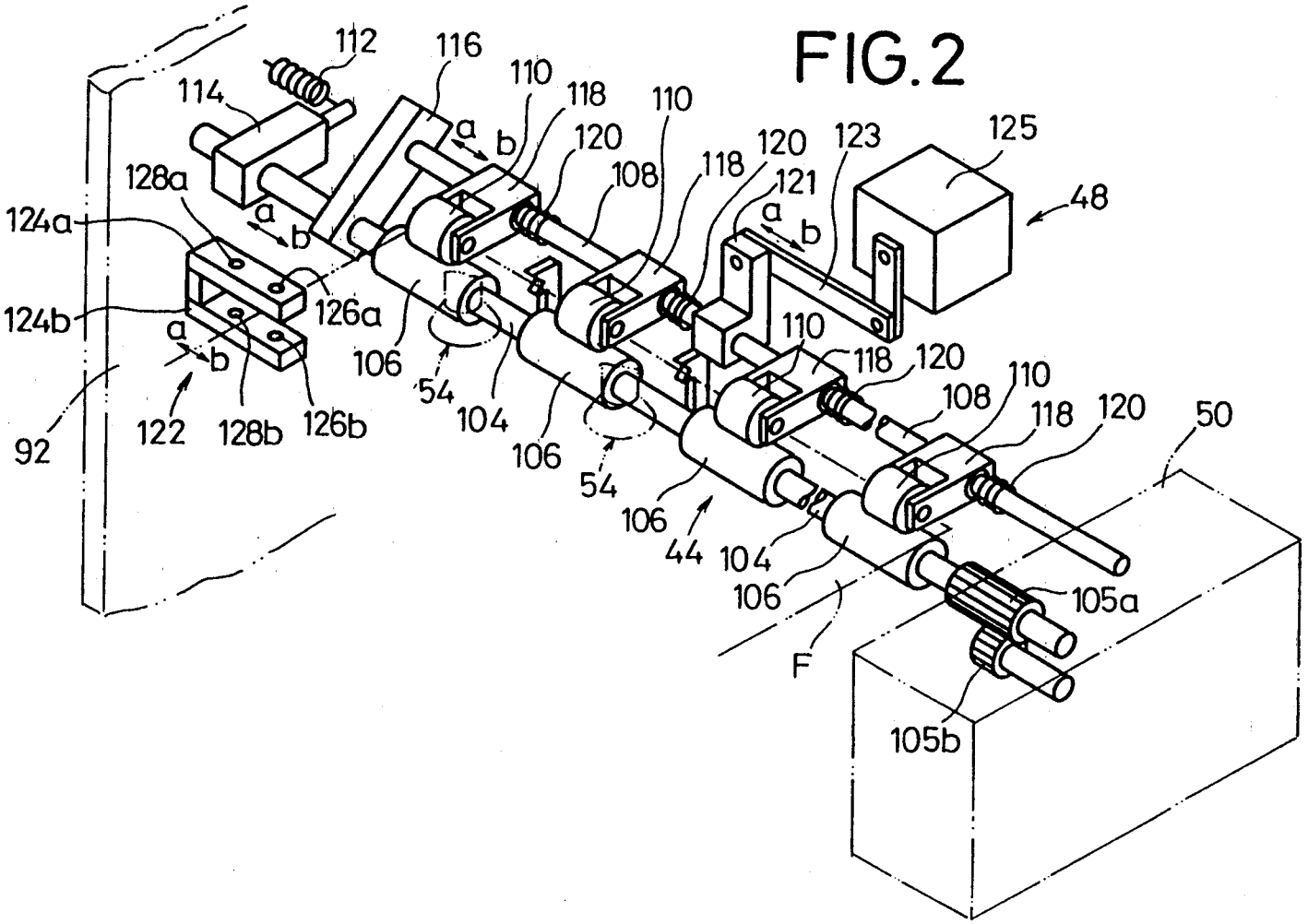
FIG. 2 is a fragmentary perspective view of a grip feed mechanism and a position correcting mechanism of the sheet supply apparatus.

The side plate 92 shown in FIG. 2 supports a displacement detector 122 for photoelectrically detecting a displacement of the exposed film F in a direction perpendicular to the feed direction thereof. The displacement detector 122 comprises a pair of brackets 124*a*, 124*b* fixedly mounted on the side plate 92 and confronting each other across a plane in which the rollers 106, 110 abut against each other, a pair of first and second light-emitting elements 126*a*, 128*a* mounted on the brackets 124*a* and spaced from each other, and a pair of first and second light-detecting elements 126*b*, 128*b* mounted on the brackets 124*b* and spaced from each other in alignment with the respective first and second light-emitting elements 126*a*, 128*a*.

Figure 3:
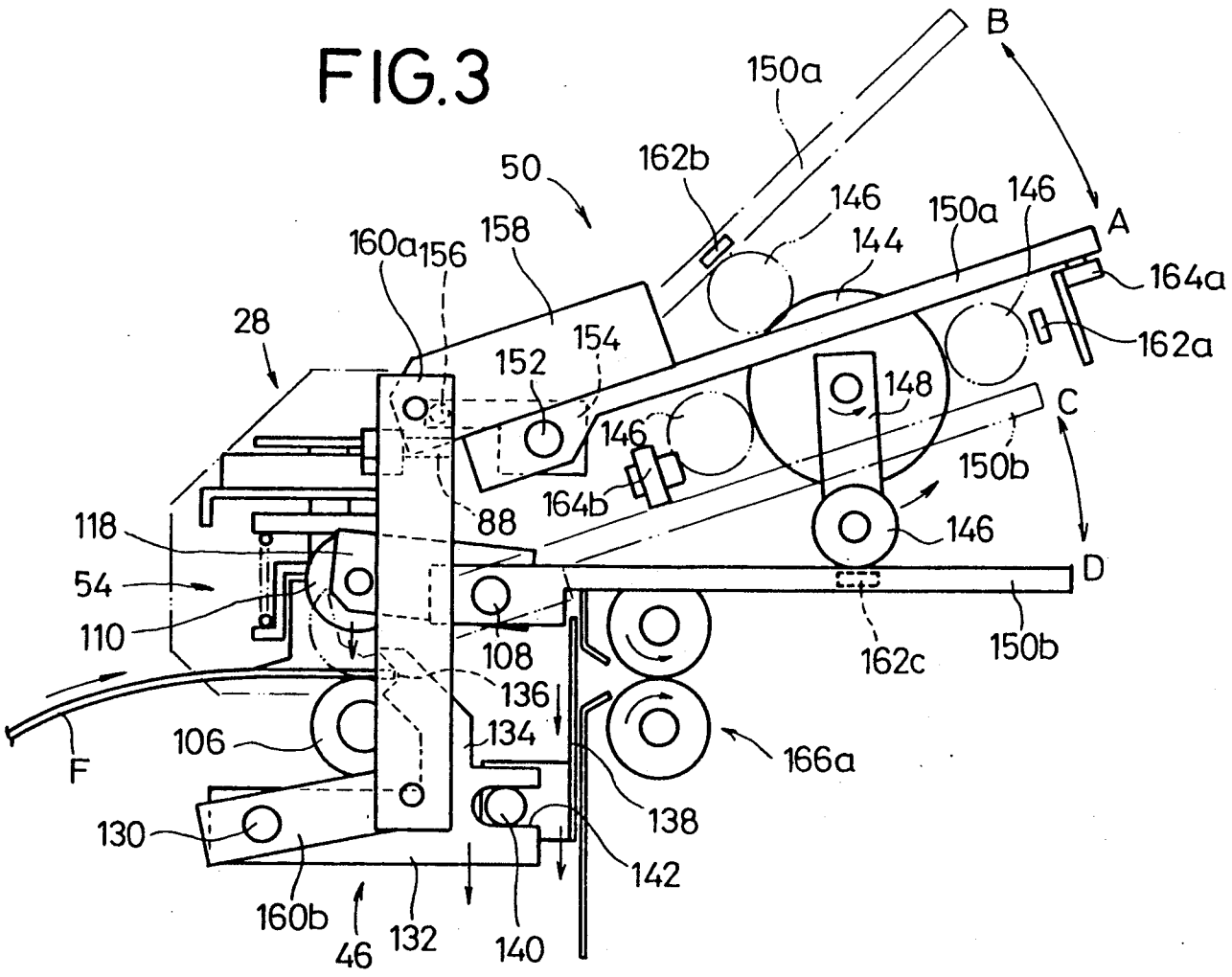
FIG. 3 is a side elevational view of a drive mechanism of the sheet supply apparatus.
Figure 4:
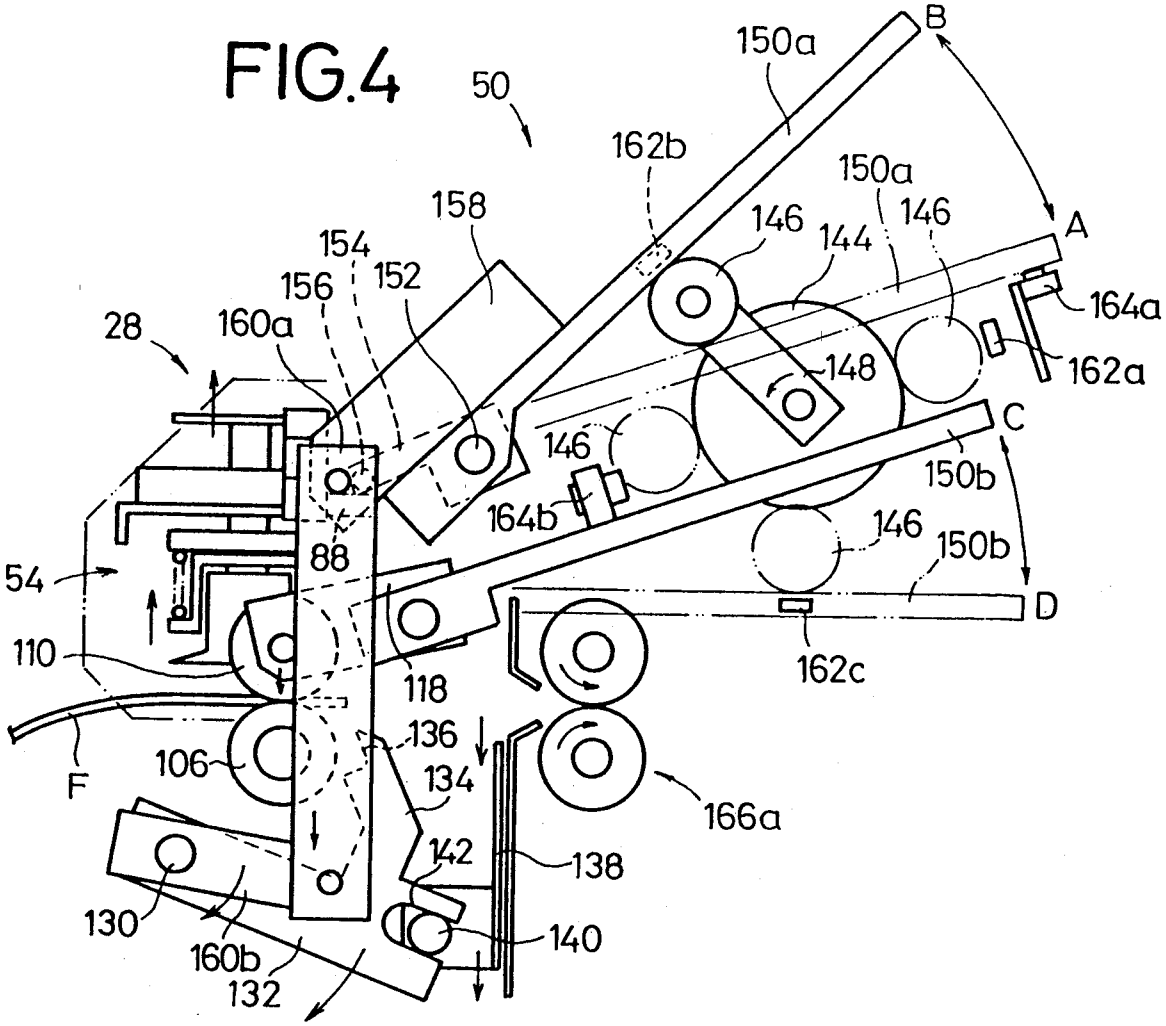
FIG. 4 is a side elevational view of the drive mechanism, showing the manner in which it operates.

As shown in FIGS. 3 and 4, the tilt correcting mechanism 46 comprises a shaft 130 parallel to the shaft 104, a plurality of arms 132 mounted on the shaft 130 at spaced intervals therealong, and a plurality of stoppers 134 fixed to the respective arms 132. The stoppers 134 have respective engaging portions 136 positioned between the rollers 106, 110 for engaging the leading end of the exposed film F. The arms 132 have respective engaging slots 142 defined in their distal ends and receiving a shaft 140 of a shutter 138. The shutter 138 serves to block light between the feeding and positioning mechanism 28 and the ID information recording device 30.

The drive mechanism 50 for actuating the suction devices 54, the grip feed mechanism 44, and the tilt correcting mechanism 46 will be described below with reference to FIGS. 3 and 4. The drive mechanism 50 comprises a motor 144, an arm 148 having one end coupled to the shaft of the motor 144 and the other end supporting a roller 146, and two levers 150*a*, 150*b* which can be angularly displaced by the roller 146.

The lever 150*a* has an end mounted on a shaft 152 positioned above and extending parallel to the shaft 108. As shown in FIG. 5, rollers 156 are mounted by respective brackets 154 on the shaft 152 between its opposite ends. The rollers 156 are held in abutting engagement with upper surfaces of the respective pins 88 that are secured to the respective levers 84. Links 160*a*, 160*b* are operatively connected to the end of the lever 150*a* by a joint 158. The link 160*b* has an end coupled to the shaft 130. When the other end of the lever 150*a* is angularly displaced between vertically spaced positions A, B (see FIGS. 3 and 4), the suction devices 54 are vertically moved through the rollers 156 and the pins 88, the stoppers 134 are vertically moved through the links 160*a*, 160*b* and the arms 132, and the shutter 138 is opened or closed through the arms 132 and the shaft 140.

One end of the lever 150*b* is coupled to the shaft 108. Consequently, the rollers 110 mounted on the shaft 108 are vertically moved when the other end of the lever 150*b* is angularly displaced between vertically spaced positions C, D (see FIGS. 3 and 4).

The position of the roller 146 at the time when the levers 150*a*, 150*b* are located in the positions A, C, respectively, the position of the roller 146 at the time when the levers 150*a*, 150*b* are located in the positions B, C, respectively, and the position of the roller 146 at the time when the levers 150*a*, 150*b* are located in the positions A, D, respectively, are detected by first, second, and third sensors 162*a*, 162*b*, 162*c*, respectively. The lever 150*a* can be held in the position A by a stopper 164*a* disposed near the first sensor 162*a*, and the lever 150*b* can be held in the position C by a stopper 164*b* disposed between the levers 150*a*, 150*b*.

Figure 9:
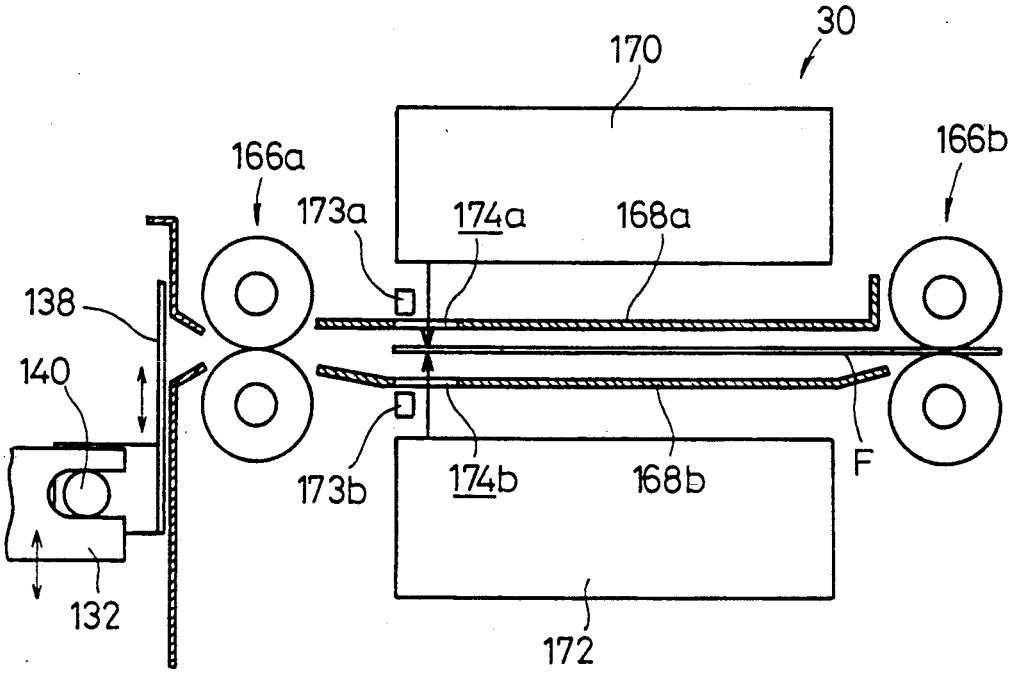
FIG. 9 is a side elevational view, partly in cross section, of an ID information recording device.

As shown in FIG. 9, the ID information recording device 30 comprises two horizontally spaced nip roller pairs 166*a*, 166*b* for gripping leading and trailing ends of the exposed film F, a pair of vertically spaced guide plates 168*a*, 168*b* extending horizontally between the nip rollers pairs 166*a*, 166*b*, a first recording unit 170 positioned above the guide plate 168*a* for optically recording ID data relative to the exposed film F on the exposed film F, a second recording unit 172 disposed below the guide plate 168*b* for optically recording date data on the exposed film F, and a photoelectric sensor composed of a light-emitting element 173*a* and a light-detecting element 173*b* for detecting the trailing end of the exposed film F. The guide plates 168*a*, 168*b* have respective openings 174*a*, 174*b* defined therein for allowing the data to be optically recorded on the exposed film F by the first and second recording units 170, 172 through the respective openings 174*a*, 174*b*.

Figure 10:
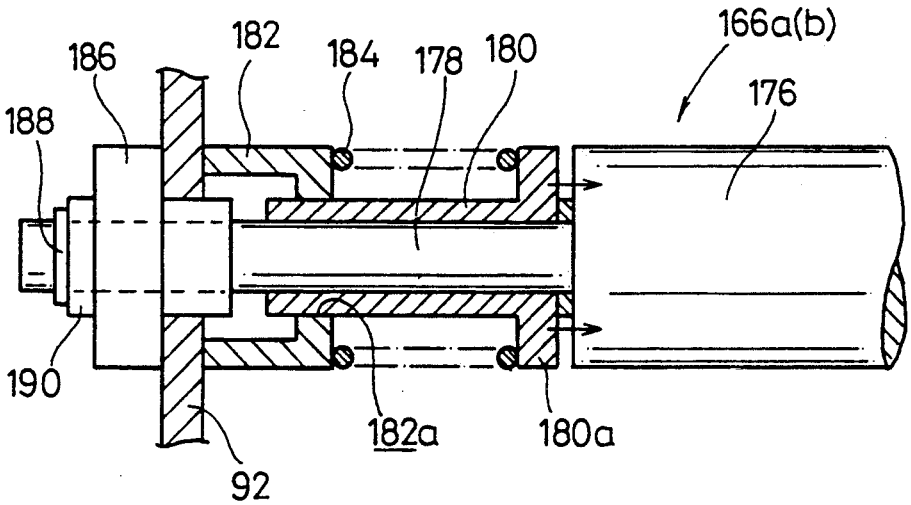
FIG. 10 is a cross-sectional view of a nip roller in the ID information recording device.

As shown in FIG. 10, each of the nip roller pairs 166*a* comprises a pair of nip rollers 176 each rotatably supported by the side plates 92 vertically disposed in the sheet supply apparatus 10. The roller 176 has a shaft 178 over which there is fitted a presser 180 engaging in a presser retainer 182 fixed to the side plate 92. The presser 180 has an angularly shaped end engaging in a complementary angularly shaped hole 182 defined in the presser retainer 182, whereby the presser 180 is prevented from rotating about the shaft 178 relatively to the presser retainer 182. A coil spring 184 is interposed under compression between the presser retainer 182 and a flange 180*a* of the presser 180 for normally urging the roller 176 toward one of the side plates 92 (not shown in FIG. 10). The shaft 178 is rotatably journaled on the side plate 92 by a plain bearing 186, and a thrust bearing 190 is mounted on the end of the shaft 178 projecting outside of the side plate 92, the thrust bearing 190 being retained in place by an E-shaped retaining ring 188.

Operation of the sheet supply apparatus 10 will be described below.

The magazine loading region 16 is loaded with magazines 14 containing unexposed films of different sizes. When the operator of the sheet supply apparatus 10 selects a desired unexposed film, the first sheet feeding mechanism 18 is displaced along the shaft 34 to the magazine 14 which contains the desired unexposed film, and then the unexposed film is removed from the magazine 14 by the suction device 32. The unexposed film taken out of the magazine 14 is then stored in the feed path 36 of the feed mechanism 20, which is then displaced along the shaft 38 to the cassette loading region 24. In the cassette loading region 24, the unexposed film is placed into the cassette 22 whose lid has been opened by the lid opening mechanism 26. With the lid closed, the cassette 22 is then removed from the sheet supply apparatus 10 by the operator, and a desired image is photographed on the film in the cassette 22.

The cassette 22 which stores the exposed film F with image information recorded thereon is loaded into the cassette loading region 24 by the operator. The lid of the cassette 2 is opened by the lid opening mechanism 26. The exposed film F is then removed from the cassette 22, and supplied to the developing device 12 through the feeding and positioning mechanism 28 and the ID information recording device 30.

The exposed film F is fed from the cassette 22 by the second sheet feeding mechanism 42 as follows: At this time, the drive mechanism 50 for actuating the feeding and positioning mechanism 28 is in the position shown in FIG. 3. That is, the motor 144 is energized to position the roller 146 closely to the third sensor 162*c*, with the lever 150*b* in the position D. The rollers 110 mounted on the shaft 108 by the respective brackets 118 are thus spaced from the respective rollers 106. The lever 150*a* is held in the position A by the stopper 164*a*. The joint 158, the links 160*a*, 160*b*, and the arms 132 cause the stoppers 134 to be positioned between the rollers 106, 110, and also cause the shutter 138 to be displaced upwardly, providing an optical shield, i.e., blocking light, between the feeding and positioning mechanism 28 and the ID information recording device 30. The rollers 156 mounted on the brackets 154 on the shaft 152 are spaced upwardly from the pins 88 secured to the levers 84 of the grip feed mechanism 44. The suction devices 54 are now positioned between the rollers 106, 110.

Then, when the motor 94 (FIG. 9) is energized, it causes the belt 102 to rotate the shaft 98, thereby angularly moving the parallel links 90*a*, 90*b* together with the frame 56, which supports the second sheet feeding mechanism 42, toward the cassette loading region 24. When the second sheet feeding mechanism 42 reaches a certain position, the suction cups 58 of the suction devices 54 abut against the exposed film F. Then, the non-illustrated vacuum source is actuated to enable the suction devices 54 to attract the exposed film F under vacuum. The motor 94 is then reversed to rotate the shaft 98 in the opposite direction. The leading end of the exposed film F attracted by the suction devices 54 enters between the rollers 106, 110 of the grip feed mechanism 44, and engages the engaging portions 136 of the stoppers 134, as shown in FIG. 3.

Figure 7:
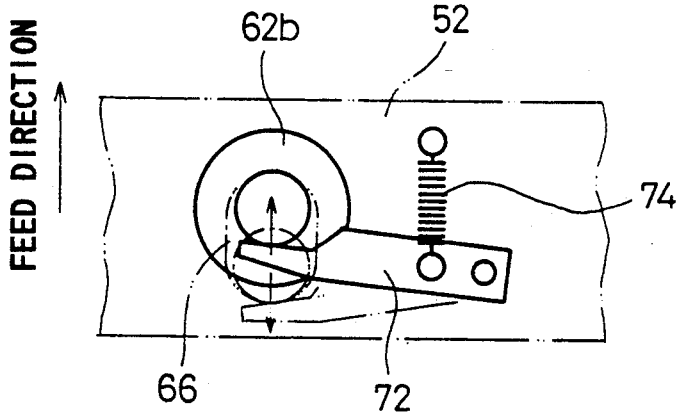
FIG. 7 is a plan view of a locking lever engaging the suction device.
Figure 11:
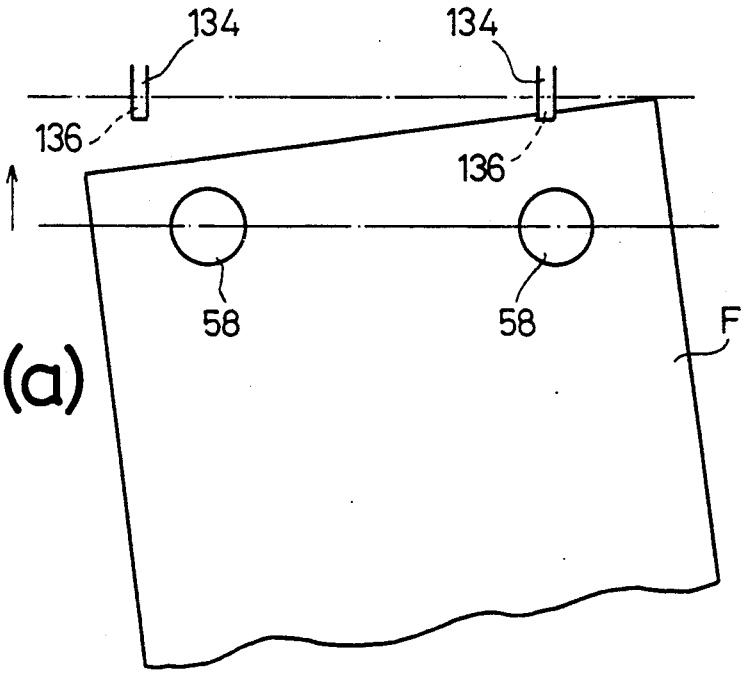
FIGS. 11(*a*) and 11(*b*) are schematic views showing the manner in which an exposed film is corrected out of a tilted condition by a tilt correcting mechanism.
Figure 11:
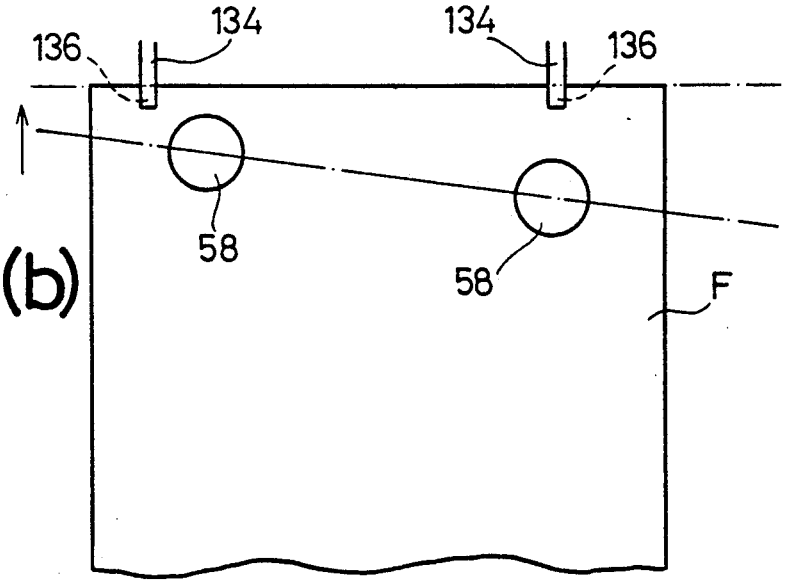

The exposed film F attracted by the suction devices 54 can be corrected out of a tilted condition as follows: It is assumed that the exposed film F is attracted by the suction cups 58 in a tilted condition, as shown in FIG. 11(*a*). When the shaft 98 is rotated, a portion of the leading end of the exposed film F is first engaged by the engaging portion 136 of one of the stoppers 134. The shaft 98 is further rotated to displace the suction cups 58 in the feed direction of the exposed film F. As shown in FIGS. 5 through 7, the suction device 54 near the portion of the exposed film F which is engaged by the engaging portion 136 is now displaced along the elongate hole 66 in the bracket 52 against the bias of the engaging lever 72. Upon continued displacement of the suction cups 58 in the feed direction, another portion of the leading end of the exposed film F is also engaged by the engaging portion 136 of the other stopper 134, as shown in FIG. 11(*b*). Accordingly, the exposed film F is corrected out of the tilted condition with respect to the feed direction.

The motor 144 of the drive mechanism 50 is energized to turn the roller 146 to a position in which it can be detected by the first sensor 162*a*. At this time, the lever 150*b* is angularly displaced from the position D to the position C, after which it is stopped by the stopper 164*b*. As the lever 150*b* is thus angularly displaced, the shaft 108 is turned about its own axis, and the rollers 110 mounted on the shaft 108 by the brackets 118 are also angularly displaced toward the rollers 106, whereupon the exposed film F is gripped between the rollers 106, 110. Thereafter, the suction devices 54 are inactivated to release the exposed film F. When the roller 146 is further angularly displaced by the moor 144 to a position in which it can be detected by the second sensor 162*b*, the lever 150*a* is angularly displaced from the position A to the position B, as shown in FIG. 4. The shaft 152 to which the lever 150*a* is coupled is also turned about its own axis, lowering the rollers 156 on the brackets 154. Since the pins 88 fixed to the levers 84 of the second sheet feeding mechanism 42 are positioned beneath the respective rollers 156 (see FIG. 5), the levers 84 are turned, lifting the guide plate 78. Upon the ascending movement of the guide plate 78, the flanges 82 on the pipes 60 of the suction devices 54 cause the suction devices 54 to move upwardly, as shown in FIGS. 5 and 6. As a consequence, the suction cups 58 of the suction devices 54 are displaced away from the exposed film F.

The upward angular displacement of the lever 150*a* into the position B causes the joint 158 and the links 160*a*, 160*b* to turn the shaft 130 clockwise about its own axis as indicated by the arrow in FIG. 5. The arms 132 are also turned clockwise as indicated by the arrow in FIG. 5, retracting the stoppers 134 downwardly. The engaging slots 142 are also displaced downwardly, causing the shaft 140 to lower, i.e., open, the shutter 138.

Then, the motor 125 of the position correcting mechanism 48 is energized (see FIG. 2). The rotation of the motor 125 is transmitted through the link 123 to the holder 121, which is linearly moved to displace the shaft 108, which supports the rollers 110, in its axial direction indicated by the arrow a. Since the shafts 108, 104 are coupled to each other by the joint 116, the shaft 104 is also axially displaced in the direction a. Therefore, the exposed film F gripped between the rollers 106, 110 is also displaced in the direction a to introduce a marginal edge thereof between the brackets 124*a*, 124*b* of the displacement detector 122 mounted on the side plate 92.

The first light-emitting element 126*a* and the first light-detecting element 126*b* serve to detect whether there is an exposed film F therebetween, and the second light-emitting element 126*b* and the second light-detecting element 128*b* serve to detect the position of a marginal edge of the exposed film F. If only the first light-emitting element 126*a* and the first light-detecting element 126*b* detect an exposed film F, then the motor 125 is energized to displace the detected exposed film F in the direction a. When a marginal edge of the exposed film F is detected by the second light-emitting element 126*b* and the second light-detecting element 128*b*, the motor 125 is deenergized. After the first light-emitting element 126*a* and the first light-detecting element 126*b*, and the second light-emitting element 126*b* and the second light-detecting element 128*b* have detected the exposed film F, the motor 125 is energized again to displace the exposed film F in the direction indicated by the arrow b until the marginal edge of the exposed film F is not detected by the second light-emitting element 126*b* and the second light-detecting element 128*b*. Then, the exposed film F is moved back in the direction a, and the motor 125 is de-energized when the marginal edge of the exposed film F is detected by the second light-emitting element 126*b* and the second light-detecting element 128*b*. In this manner, the exposed film F is positionally adjusted in the direction perpendicular to the feed direction thereof. While the exposed film F is being thus positionally adjusted, the suction cups 58 are spaced away from the exposed film F. Therefore, when the exposed film F is displaced in the direction a or b, it is not rubbed by the suction cups 58 and hence is not damaged thereby.

Subsequently, the rollers 106 on the shaft 104 are rotated by the non-illustrated rotary actuator of the drive mechanism 50 to feed the exposed film F into the ID information recording device 30. At this time, the exposed film F has been corrected out of a tilted condition by the stoppers 134, and has also been positionally corrected in the direction perpendicular to the feed direction by the position correcting mechanism 48 and the displacement detector 122, as described above. Furthermore, as shown in FIG. 2, the rollers 106 are normally urged toward the side plate 92 by the coil spring 112 which acts on the shaft 104 through the bracket 114. Accordingly, the exposed film F is fed in a desired posture to the ID information recording device 30 without positional displacement in the direction perpendicular to the feed direction.

When the exposed film F is completely fed into the ID information recording device 30, the roller 146 is angularly displaced by the motor 144 to a position in the vicinity of the stopper 164*b*, allowing the lever 150*a* to return from the position B to the position A (see FIG. 3). The suction devices 54 are lowered, the stoppers 134 are elevated into the position between the rollers 106, 110, and the shutter 138 is lifted, providing an optical shield between the feeding and positioning mechanism 28 and the ID information recording device 30. When the roller 146 further is angularly displaced until it can be detected by the third sensor 162*c*, the lever 150*b* is angularly displaced to the position D, lifting the rollers 110 away from the rollers 106. The feeding and positioning mechanism 28 is now ready for a next exposed film F.

The exposed film F that has been fed into the ID information recording device 30 is stopped when the trailing end is detected by the sensor composed of the light-emitting element 173*a* and the light-detecting element 173*b* (see FIG. 9). Then, ID data and date data are recorded on the trailing end of the exposed film F by the first and second recording units 170, 172 through the respective openings 174*a*, 174*b* in the guide plates 168*a*, 168*b*. Since the nip rollers 176 of the nip roller pairs 166*a*, 166*b* in the ID information recording device 30 are normally urged toward one of the side plates 92 by the coil springs 184, as shown in FIG. 10, the exposed film F is accurately fed into the ID information recording device 30 without unwanted positional displacement. Therefore, the ID and date data are recorded accurately in a desired position on the trailing end of the exposed film F. Inasmuch as the shutter 138 is closed between the feeding and positioning mechanism 28 and the ID information recording device 30 at this time, the light that is emitted by the first and second recording units 170, 172 to record the ID data and date data is prevented from leaking toward the feeding and positioning mechanism 28, and hence from adversely affecting an exposed film F to be fed into the ID information recording device 30. Extraneous light which may enter when the cassette 22 is loaded into the cassette loading region 24 is also prevented from adversely affecting the exposed film F while the ID data and date data is being recorded on the exposed film F in the ID information recording device 30.

The exposed film F on which the ID data and date data has been recorded is then fed from the ID information recording device 30 into the developing device 12, in which the recorded image and data on the exposed film F are developed. The film with the developed image and data is then removed from the developing device 12 for subsequent use.

The sheet supply apparatus according to the present invention offers the following advantages:

When a sheet such as a film F is fed from the cassette 22 to the rollers 106, 110, it is corrected out of a tilted condition with respect to the feed direction. Then, the sheet is positionally adjusted in the direction perpendicular to the feed direction while the sheet is being gripped by the rollers 106, 110. When the sheet is corrected and adjusted in position, no special positioning station is required to position the sheet, but the sheet can be positioned on its way toward the ID information recording device 30. As a consequence, the sheet supply apparatus is relatively small in size, and takes a reduced period of time in positioning the sheet. The sheet is positionally adjusted or positioned in the direction perpendicular to the feed direction while the sheet is being gripped by the rollers 106, 110. Therefore, the sheet is prevented from being curved and/or from being rubbed by the rollers 106, 110. The sheet can thus well and smoothly be fed, and is protected against damage.

Although a certain preferred embodiment of the present invention has been shown and described in detail, it should be understood that various changes and modifications may be made therein without departing from the scope of the appended claims.

What is claimed is:

1. A sheet supply apparatus comprising:

at least a pair of rollers for gripping and feeding a sheet;

a feeding mechanism for feeding a sheet from a storage cassette and supplying the sheet along a feed path to said pair of rollers, said feeding mechanism having suction means movable into said feed path for attracting the sheet under vacuum;

a skew correcting mechanism having for correcting the sheet from a skewed condition with respect to a direction transverse to said feed path, said skew correcting mechanism having at least a pair of stoppers movable into said feed path for engaging a leading end of the sheet to correct the sheet from the skewed condition;

a position correcting mechanism for displacing said pair of rollers in said direction while the pair of rollers is gripping the sheet, to correct the sheet positionally with respect to said direction; and a drive mechanism for displacing said suction means and said stoppers between said feed path and respective positions outside of said feed path.

2. A sheet supply apparatus according to claim 1, wherein said suction means comprises at least one suction cup for attracting the sheet under vacuum.

3. A sheet supply apparatus according to claim 1, wherein said feeding mechanism comprises a motor, a pulley, a belt operatively interconnecting said motor and said pulley for rotating said pulley in response to energization of said motor, and a link coupled to said pulley for displacing said suction means along said feed path upon rotation of said pulley.

4. A sheet supply apparatus according to claim 1, wherein said stoppers are spaced from each other in said direction.

5. A sheet supply apparatus according to claim 1, further including first and second shafts on which said pair of rollers is mounted respectively, said skew correcting mechanism comprising a third shaft extending parallel to said first and second shafts, at least a pair of arms mounted on said third shaft and spaced from each other, said stoppers being fixed to said arms, respectively, for abutting engagement with said sheet.

6. A sheet supply apparatus according to claim 1, wherein said position correcting mechanism comprises displacing means for displacing said pair of rollers, and detecting means for detecting the sheet gripped by the pair of rollers displaced by said displacing means.

7. A sheet supply apparatus according to claim 6, further including first and second shafts on which said pair of rollers is mounted respectively, said displacing means comprising a holder mounted on said second shaft, a link pivotally coupled to said holder, and a motor operatively coupled to said link for angularly moving said link to displace said pair of rollers in said direction.

8. A sheet supply apparatus according to claim 7, wherein said detecting means comprises a photoelectric sensor having a light-emitting element and a light-detecting element.

9. A sheet supply apparatus according to claim 1, wherein said drive mechanism includes means for moving said rollers toward and away from each other.

10. A sheet supply apparatus according to claim 1, wherein said drive mechanism includes means for displacing said suction means away from said feed path.

11. A sheet supply apparatus according to claim 1, wherein said drive mechanism includes means for pressing said rollers against each other in a direction transverse to said feed path.

12. A sheet supply apparatus according to claim 1, wherein said drive mechanism includes first means for displacing said suction means away from said feed path, second means for moving said rollers toward and away from each other, third means for displacing said stoppers between the position outside of said feed path and a position between said rollers, and a single actuator for actuating said first, second, and third means.

* * * * *